United States Patent [19]

Mayer et al.

[11] 4,011,845

[45] Mar. 15, 1977

[54] INTERNAL COMBUSTION ENGINE OPERATION UTILIZING EXHAUST GAS RECIRCULATION

[75] Inventors: Edward A. Mayer, Newburgh; Donald W. Plungis, Fishkill, both of N.Y.

[73] Assignee: Texaco Inc., New York, N.Y.

[22] Filed: Dec. 17, 1974

[21] Appl. No.: 533,588

Related U.S. Application Data

[63] Continuation of Ser. No. 259,064, June 2, 1972, abandoned.

[52] U.S. Cl. ..... 123/119 A; 123/32 EA

[51] Int. Cl.[2] ..... F02B 33/00

[58] Field of Search ..... 123/119 A, 32 EA

[56] References Cited

UNITED STATES PATENTS

| | | | |
|---|---|---|---|
| 2,114,548 | 4/1938 | Stadlman | 123/119 A |
| 3,470,857 | 10/1969 | Stivender | 123/119 A |
| 3,610,219 | 10/1971 | Sciabica | 123/32 EA |
| 3,612,020 | 10/1971 | Moulds | 123/32 EA |
| 3,677,239 | 7/1972 | Elkins | 123/119 A |

FOREIGN PATENTS OR APPLICATIONS

| | | | |
|---|---|---|---|
| 902,332 | 7/1949 | Germany | 123/119 A |
| 238,732 | 8/1945 | Switzerland | 123/119 A |

*Primary Examiner*—Charles J. Myhre
*Assistant Examiner*—Daniel J. O'Connor
*Attorney, Agent, or Firm*—T. H. Whaley; C. G. Ries; Robert B. Burns

[57] ABSTRACT

The invention relates to a method and apparatus for reducing the amount of undesirable products of combustion which are discharged to the atmosphere from an internal combustion engine during operation of the latter. The apparatus comprises, means for segregating a portion of an exhaust gas stream from the engine's exhaust discharge manifold or valve. The hot exhaust gas segment is cooled, combined with air to form a preliminary mixture, and delivered to the engine's combustion chambers. A predetermined volume of fuel is injected into the combustion chamber whereby to intermix with a portion of the preliminary mixture in such a manner that at least a part of the latter becomes combustible.

The apparatus for achieving the method comprises, means for recycling said segment of said hot exhaust gas. It further comprises means for controllably regulating the flow of the latter in response to the load variations imposed on the engine.

6 Claims, 1 Drawing Figure

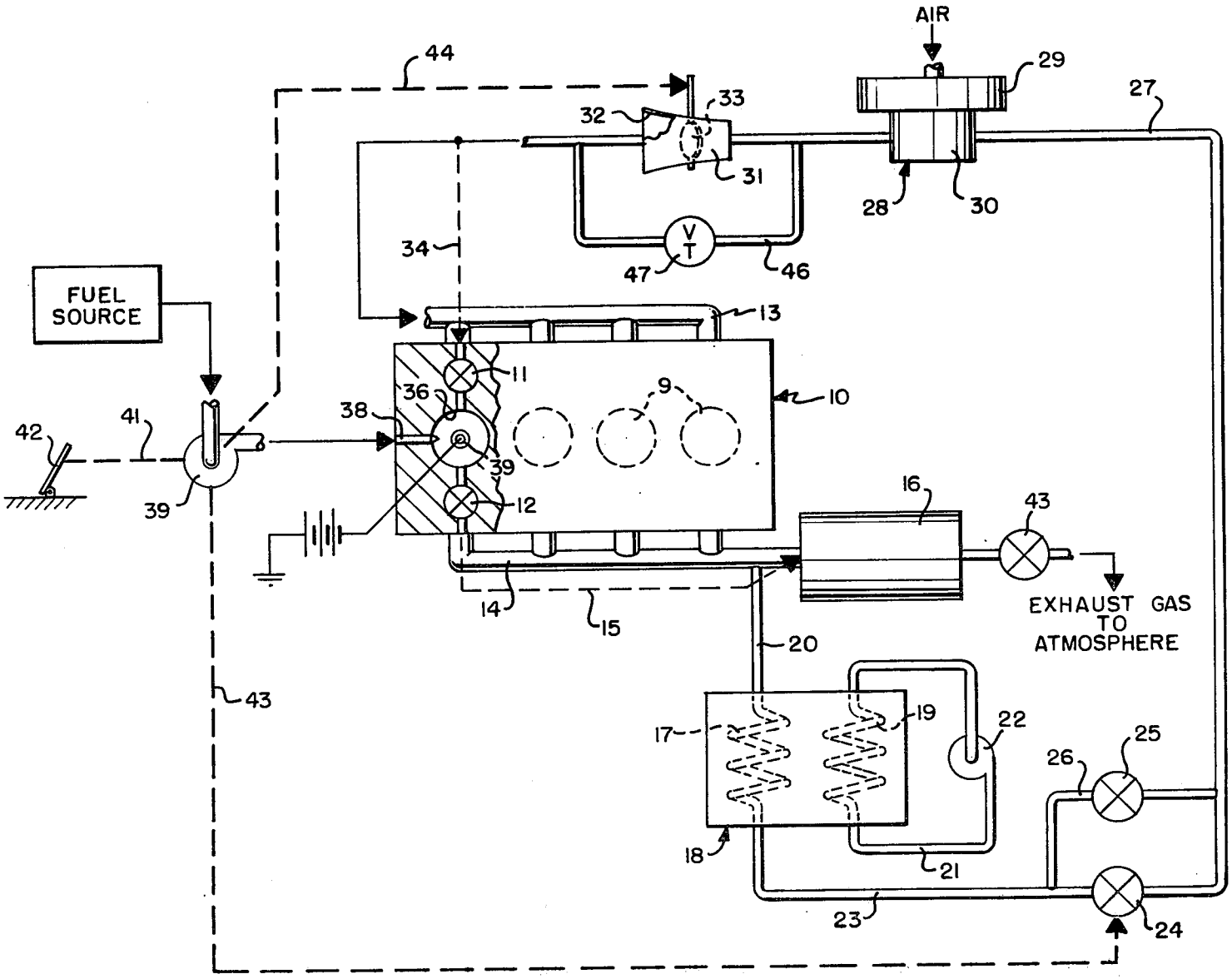
AIR
EXHAUST GAS TO ATMOSPHERE
FUEL SOURCE
V
T

INTERNAL COMBUSTION ENGINE OPERATION UTILIZING EXHAUST GAS RECIRCULATION

The invention herein described was made in the course of or under contract or subcontract thereunder with the U.S. Department of Defense.

This is a continuation of application Ser. No. 259,064, filed June 2, 1972, now abandoned.

BACKGROUND OF THE INVENTION

Operation of an internal combustion engine normally includes the burning of a combustible mixture comprising a fuel, together with a combustion supporting gas. Among the most common mixtures is a carbonaceous fuel, plus atmospheric air. The combustible mixture is rapidly burned in a combustion chamber whereby to displace a moving element such as a piston or the like on a power stroke. Concomitant with such burning, the resulting exhaust gases will normally be muffled, and discharged to the atmosphere. To minimize the degree of atmospheric pollution caused by the indiscriminate discharge of these exhaust gases, various governmental agencies, as well as industry in general, have determined to decrease the amount of such discharge.

Among the more noxious of the air polluting gases discharged to the atmosphere are the various oxides of nitrogen. These are generally referred to hereinafter, as well as in the industry as $NO_x$.

While not the most detrimental of the substances discharged into the atmosphere, $NO_x$ does account for a large proportion of the total engine emission gases. Further, it depends for its potency as a pollutant on the character of the particular combustion, and the composition of the fuel burned.

To substantially reduce and even eliminate the amount of $NO_x$ discharged to the atmosphere from an engine of the internal combustion type, the present method and apparatus are provided. In essence, the instant method comprises the sequential segregation of and recycling of a minor portion of the total exhaust gas stream created in the engine. Said segmented portion, although it does not support combustion, is intimately mixed with another combustion supporting gas to form a preliminary mixture.

The preliminary gaseous mixture is thereafter introduced into a combustion chamber together with a predetermined amount of fuel, either in liquid or gaseous phase. The forced intermingling of the latter with a portion of the preliminary mixture, provides a combustible fluid that is thereafter ignited by positive sparking action, or by other suitable vehicle.

To achieve the noted objectives, the invention more specifically comprises a method for operating an engine in which a fuel is rapidly burned in the presence of a combustion supporting medium. The latter, however, comprises a major portion of air and a minor portion of cooled, recycled exhaust gas. Characteristic of the exhaust gas, is in the physical property of its being highly adsorbent of heat, and further does not take part directly in the combustion process. The overall result of this type burning is that the temperature within a combustion chamber will be substantially reduced. Further, with low temperature combustion, there will be a substantial reduction in, or complete elimination of $NO_x$ which might otherwise hav occurred with an ordinary air/fuel mixture.

The apparatus of the invention is directed to the system, or means for achieving the circumstances in the engine combustion chamber which results in the desired burning. Said means further comprises a control arrangement whereby the amount of exhaust gas which is recycled into the combustion chamber is varied in accordance with the load imposed upon the engine. In effect the flow of heated recycled exhaust gas is varied in accordance with the throttle position such as to vary the volume of exhaust gas recycled, from a maximum of approximately 30% by volume, at idle speed, to a minimum of approximately 15% by volume under loaded conditions.

DESCRIPTION OF THE DRAWINGS

The FIGURE illustrates diagrammatically an internal combustion engine of the type contemplated with the various components shown linked through flow lines carrying fuel, air and/or exhaust gas.

The internal combustion engine presently contemplated can be any of a number presently known including a spark ignited internal combustion engine type, or the diesel type.

The fuel adapted for use in the disclosed method as mentioned is of a carbonaceous base. The exhaust gases forming the residue of the combustion of such a fuel, generally include the above noted $NO_x$, together with various unburned hydrocarbons, as well as CO.

While the presently disclosed concept is described in relation to a single combustion chamber within an engine, this is not a confining limitation to the scope of the disclosure. It is understood that the novel premixing of air, together with a segment of the recycled exhaust gas, can form the basis of a mixture introduced to each cylinder sequentially or to the one or more cylinders of an entire engine unit.

The novel method, however, is found to function effectively in the instance of the controlled type combustion fuel burning as disclosed in U.S. Pat. No. 2,484,009.

In the latter mentioned method of controlled combustion, air is introduced to the upper end of a combustion chamber in a manner to assume a rapidly cycling or rotating stream. Simultaneously, a measured amount of fuel is forcefully injected into the chamber to mingle with a portion of the circulating air stream. The point of introduction of fuel to the combustion chamber is preferably in the immediate proximity of the positive ignition means. In the instant arrangement such means is most conveniently a spark plug connected to an engine ignition system.

Because of the close proximity of the fuel and air mixture within the combustion chamber to the spark plug, the mixture is readily ignited to produce a rapidly propagating flame front.

Referring again to the FIGURE, the engine shown diagrammatically at 10 represents an internal combustion engine having a plurality of cylinders 9 disposed therein. In the normal manner, each of said cylinders is provided with a pair of valves 11 and 12 which operate sequentially to introduce incoming air and to discharge exhausted gases.

The respective intake valves 11 are communicated to a common intake manifold 13. Similarly, exhaust valves 12 at each combustion chamber are mutually communicated through a common exhaust manifold 14. Such manifolds are relatively common on engines of this type. It is understood however, that each of said combustion chambers might similarly be communicated by means of discrete intake and/or discharge conduits whereby each chamber will receive a premeasured amount of air, and recycled gas as well as fuel.

The downstream side of engine 10 is provided with a muffler 16 into which hot exhaust gases are fed from manifold 14. In the present arrangement, a catalytic type muffler is utilized which can as mentioned, be communicated to each combustion chamber discharge valve through an individual conduit 15. The conduit will normally function to carry a major portion of the exhaust created within a cylinder, and will deliver it into the muffler. This type of muffler is known in the prior art and not only deadens the normal noise level of the hot exhaust gas, but also promotes reaction of the exhaust gas components with air within the muffler to minimize the amount of harmful emissions discharged to the atmosphere.

Normally, gas flow through the catalytic or other muffler 16 will be directed by way of the muffler passages, to the atmosphere. However, in the present arrangement a portion of the hot exhaust gas, preferably at maximum pressure, is diverted from the main exhaust gas stream. Said portion of hot exhaust gas is conducted by line 20 to one coil or side 17 of heat exchanger 18.

The corresponding side of the heat exchanger 18 is provided with a means, such as a passage 19, for circulating a cooling medium. The latter can be atmospheric air or even engine cooling water. Normally, said water would be drawn from the discharge side 21 of engine pump 22 and circulated through heat exchanger passage 19.

The downstream side of heat exchanger 18 is connected through outlet line 23, to an exhaust metering valve 24. Said valve includes means for rapidly regulating the passage opening therethrough such that the flow of cooled exhaust gases can be readily adjusted whereby to alter the amount thereof subsequently intermixed with the preliminary charge.

A by-pass arm 26 communicated with the exhaust metering valve 24 inlet side, includes a constant opening internal passage or flow control means 25 to permit a minimum flow of the cooled exhaust gas around metering valve 24 at such time as the engine is adjusted to maximum fuel flow or power.

The downstream side of exhaust metering valve 24 is further communicated by line 27 with flow integrator 28. In the latter, cooled, metered exhaust gas is injected into and combined with a flow of combustion supporting medium, normally air. In said flow integration, atmospheric air is introduced through a cleaning unit 29, to a mixing chamber 30 whereby to be intermixed with the stream of incoming exhaust gas.

The resulting fluid comprises a preliminary mixture of the combustion supporting air, together with the non-combustion supporting exhaust gas portion. This aqueous mixture is thereafter introduced to a throttle member 31 having a central throat section 32. A throttle plate 33 is pivotally mounted in the throat and is operable to regulate fluid flow through said throat section 32.

The latter is communicated by way of conduit 34 with combustion chamber 36 through the intake valve 11. As intake valve 11 is actuated to the open position, the reduced pressure within combustion chamber 36 will draw said preliminary gaseous mixture thereinto.

As above noted, with respect to the controlled combustion engine, the preliminary gaseous mixture is forcefully drawn into the combustion chamber 36 in a manner to swirl about the upper end thereof. Simultaneously, a predetermined amount of fuel, whether in liquid or gaseous form, is fed through nozzle 38 into the swirling mass. The resulting localized path of gas and fuel thus form a combustible mixture which, when under the influence of a spark from the plug 35 will cause ignition.

Subsequent to commencement of the power stroke under the expanding gas, exhaust valve 12 will open thereby releasing the pressurized, hot exhaust gases from combustion chamber 36 and into exhaust manifold 14. From the latter, the various exhaust gas streams enter common exhaust manifold 14 and are led to muffler 16.

Toward most economically regulating engine operation in accordance with the present method of reducing emissions therefrom, engine fuel pump 39 is provided with a pivotally mounted lever 41. Said lever 41, when actuated by a movement of the accelerator foot pedal 42, causes a jet of pressurized fuel to enter chamber 36 by way of nozzle 38. Cable means 43 connected to the fuel pump 39 is also connected with movable plate 33 in exhaust metering valve 24. Thus, as the amount of fuel introduced to the engine combustion chamber 36 is increased to accommodate a heavier load, the exhaust metering valve 24 will be gradually urged toward a closed position.

Simultaneously with the regulation of fuel fed to combustion chamber 36, the flow of preliminary mixture passing through throttle valve 31 is regulated. Such regulation is achieved by a connection such as a linkage or cable 44, which likewise operably engages fuel pump 39 with throttle 31. Thus, for any condition of engine loading from idle speed to maximum load, the entire system can be regulated by the operator through a single adjustment.

The disclosed exhaust gas recycling system is found to be effective under virtually all engine operating conditions. Commencing with the hot exhaust gas exiting from the exhaust valve 12, the temperature of said gas will be within the approximate range of 600° to 1700° F. The major portion of such hot exhaust will of course enter catalytic muffler 16 whereby to be treated prior to discharge through the muffler downstream end. However, the minor segment of exhaust gas for recycling purposes is removed through line 20 rather than entering said muffler.

The volume of exhaust gas actually used in the preliminary mixture will as mentioned, vary between about 15 to 30% by volume of the entire preliminary mixture introduced to the combustion chamber 36. However, since gas pressure at the inlet side of muffler 16 is maximum for the system, the pressure in line 20 will be substantially at a maximum value. The volume or rate of such exhaust gas flow will be regulated by the back pressure in said line 20 which is in turn contingent on the adjustment of control valve 24 as well as on orifice or valve 43 connected to the muffler 16 downstream side.

The heated exhaust gas is thereafter introduced to heat exchanger 18 such that the gas will be reduced to a temperature within the range of 100° to 140° F. This temperature of course is contingent on the condition of the coolant medium which as mentioned, can be atmospheric air, engine cooling water passed from pump 22, or a similar compatible cooling medium.

In any event the cooled gas, now at a slightly reduced pressure and volume, is carried through line 23 to the upstream side of control valve 24. Gas flow through said valve 24 will as noted be contingent on the fuel flow as determined by pump 39 which is responsive in turn to the actuation of the engine control pedal 42.

Downstream of control valve 24 then, the metered cooled exhaust stream is carried through line 27 to flow integrator 28. In said member the primary function achieved is that the cooled exhaust stream is combined with air of other combustion supporting gas being drawn to said integrator. Preferably, the mixing chamber 30 of flow integrator 28 provides a maximum intermixing of the two gases to afford a more efficient operation at combustion chamber 36.

The mixed stream now further cooled by the introduction of atmospheric air to the cooled exhaust mixture is carried to the throttling member 31. Said valve as mentioned is interconnected with the valve 24 through the metering pump 39, all of said members being mutually actuated by control pedal 42. The combustion supporting stream is now metered through the throttling valve 31, actuatable by the butterfly plate 33. Thereafter, the preliminary gaseous mixture enters inlet valve 30 as the latter opens whereby to be forcibly introduced to the combustion chamber 36 in the manner preferably noted.

Bypass arm 46 around valve 32 includes bypass throttle valve 47. The function of said bypass valve is initiated essentially at engine idle and deceleration conditions. Said valve passes the desired amount of exhaust gas/air mixture at such time as the fuel pump 39 is reduced to idle or deceleration conditions. Said valve further affects a reproducible intake manifold vacuum without being affected by the presence of soot in the recirculated exhaust.

Other modifications and variations of the invention as hereinbefore set forth may be made without departing from the spirit and scope thereof, and therefore, only such limitations should be imposed as are indicated in the appended claims.

The embodiments of the invention in which an exclusive property or privilege is claimed are defined as follows:

1. In an internal combustion engine having at least one combustion chamber including; exhaust and intake valves communicated therewith, the latter mentioned valve being operable to cyclically admit a preliminary combustion supporting gaseous mixture to said combustion chamber, and an exhaust valve being operable to pass a hot exhaust stream therefrom, and fuel injection means communicated with said combustion chamber being operable to cyclically introduce a stream of fuel to the latter, conduit means communicating said exhaust valve with said intake valve to segregate and carry a stream of gas to the latter;

gas mixing means positioned in said conduit means, and being communicated with a source of a combustion supporting medium to intermix the latter with said stream of exhaust gas whereby to form a preliminary gaseous mixture;

first flow regulating means having a by-pass means therein; being positioned in said conduit means at a point down stream of said gas mixing means to receive said preliminary mixture of exhaust gas and combustion supporting medium, said first flow regulating means being connected to said intake valve whereby to controllably regulate the flow of said preliminary gas mixture, passing to said intake valve, and second flow regulating means having by-pass means therein, being disposed in said conduit means upstream of said gas mixture means, and being operable to regulate the flow of said exhaust gas stream subsequent to discharge thereof from said exhaust valve.

2. In an apparatus as defined in claim 1 wherein said respective flow regulating means includes: adjustable valve means positioned upstream and downstream of said mixer means, and being concurrently operable to regulate the two streams of gas passing through said respective valve means.

3. In an apparatus as defined in claim 1, wherein said respective flow regulating means are concurrently operable in response to the engine load whereby to adjust the flows of hot exhaust gas and combustible gas mixture.

4. In an apparatus as defined in claim 1 including: non-adjustable by-pass means positioned around each of said first and second flow regulating means, whereby to maintain a constant flow of preliminary gaseous mixture, as well as hot exhaust gas, when said engine is operating under idle and decelerating conditions.

5. In an apparatus as defined in claim 1 wherein said first flow control means includes: a fixed opening flow control means (47) connected in parallel with said first control means to pass gas therethrough when said first control means is in closed position.

6. In an apparatus as defined in claim 1 wherein said second flow control means includes a fixed opening flow control valve (25) connected in parallel with said second flow control means to regulate the flow of exhaust gas therethrough when said second flow control means is in closed position.

* * * * *